US006726511B1

(12) United States Patent
Schelman

(10) Patent No.: US 6,726,511 B1
(45) Date of Patent: Apr. 27, 2004

(54) INTERNALLY PORTED HYDRAULIC CYLINDER ASSEMBLY

(75) Inventor: Buddy C. Schelman, New Berlin, WI (US)

(73) Assignee: T.J. Brooks Company—division of Hanna Cylinders, Libertyville, IL (US)

( * ) Notice: Subject to any disclaimer, the term of this patent is extended or adjusted under 35 U.S.C. 154(b) by 0 days.

(21) Appl. No.: 10/238,035

(22) Filed: Sep. 9, 2002

Related U.S. Application Data

(60) Provisional application No. 60/322,171, filed on Sep. 11, 2001.

(51) Int. Cl.[7] ..... B63H 5/125

(52) U.S. Cl. ..... 440/61 T; 440/53; 440/57; 92/163

(58) Field of Search ..... 440/53, 57, 58, 440/59, 61 C, 61 R, 61 T; 91/401, 409, 422; 92/163, 164, 168; 188/289, 318, 322.21

(56) References Cited

U.S. PATENT DOCUMENTS

| | | | | | |
|---|---|---|---|---|---|
| 3,004,524 | A | * | 10/1961 | McCay et al. | 91/401 |
| 3,665,816 | A | * | 5/1972 | Caudle | 92/168 |
| 3,962,955 | A | * | 6/1976 | Borst et al. | 91/401 |
| 4,003,297 | A | | 1/1977 | Mott | 92/78 |
| 4,050,359 | A | * | 9/1977 | Mayer | 91/422 |
| 4,242,947 | A | * | 1/1981 | Renner et al. | 91/108 |
| 4,363,629 | A | * | 12/1982 | Hall et al. | 440/61 R |
| 4,384,511 | A | | 5/1983 | Mefferd | 91/164 |
| 4,469,017 | A | * | 9/1984 | Hanlon | 92/168 |
| 4,544,362 | A | | 10/1985 | Arneson | 440/61 |
| 4,645,463 | A | | 2/1987 | Arneson | 440/57 |
| 4,825,752 | A | * | 5/1989 | Kiffmeyer | 91/422 |
| 4,887,515 | A | | 12/1989 | Tabata | 92/80 |
| 4,909,175 | A | | 3/1990 | Arnseson | 114/285 |
| 5,355,775 | A | | 10/1994 | Wolff | 92/168 |
| 5,429,038 | A | | 7/1995 | Black | 92/86 |
| 5,584,225 | A | | 12/1996 | Arvidsson et al. | 91/405 |
| 5,667,415 | A | | 9/1997 | Arneson | 440/66 |
| 5,806,406 | A | | 9/1998 | Petterson | 92/164 |
| 5,839,353 | A | | 11/1998 | Mecham | 92/258 |
| 5,907,273 | A | | 5/1999 | Ross, Jr. et al. | 338/176 |
| 6,039,617 | A | * | 3/2000 | Nakamura | 440/61 R |
| 6,044,752 | A | | 4/2000 | Harigaya | 92/163 |
| 6,165,032 | A | * | 12/2000 | Nakamura | 440/61 R |
| 6,467,593 | B1 | * | 10/2002 | Corradini et al. | 188/289 |

* cited by examiner

*Primary Examiner*—S. Joseph Morano
*Assistant Examiner*—Lars A. Olson
(74) *Attorney, Agent, or Firm*—Ryan Kromholz & Manion, S.C.

(57) ABSTRACT

A fluid cylinder such as a hydraulic cylinder used on marine engines to control the steering direction and/or trim position of a propeller shaft comprises internally ported fluid lines located in line with the longitudinal axis of the cylinder and may be either ported in the base of such a cylinder or, alternatively, in the head.

21 Claims, 11 Drawing Sheets

INTERNALLY PORTED HYDRAULIC CYLINDER ASSEMBLY

RELATED APPLICATION

This application claims the benefit of U.S. Provisional application Ser. No. 60/322,171 filed Sep. 11, 2001.

BACKGROUND OF THE INVENTION

The present invention relates generally to fluid cylinder assemblies, and more particularly to improvements in fluid cylinder and piston assemblies used on machinery. Of particular significance are the type used in the operation of marine vessels such as boats, ships, and the like. For example, Arneson-type marine outdrive systems that utilize fluid cylinders for trim and steering functions are described in U.S. Pat. Nos. 4,544,362, 4,645,463 and 5,667,415.

Fluid operated piston and cylinder assemblies are used in many forms and must be capable of continued reliable operation without failure. Typical applications include use in construction equipment, aircraft, watercraft, military vehicles, cranes and jacks. In many applications the cylinder assemblies are exposed to severe natural elements or other harsh conditions, and generally receive little attention or maintenance. Marine applications can be particularly harmful, as the cylinder assemblies may be partially to fully submerged in the water, and may be exposed to collisions with floating or submerged debris. Therefore, the cylinder assemblies must be sufficiently rugged to receive impacts, shocks, vibrations and external pressures without leaking or breaking, especially when used in marine applications.

A major drawback of present piston and cylinder assemblies is the presence of external fluid lines that provide fluid to and receive fluid from the cylinder. These lines typically extend from a port in the cylinder to a fluid pump, a reservoir or a valve assembly, and are typically constructed from reinforced rubber or from rubber conduit reinforced with braided metallic fibers. The external fluid lines may be subject to unclean environments, chemical exposure and prolonged heat and sun exposure. In some applications, such as construction equipment, the physical location of the fluid lines makes them vulnerable to being snagged by moving parts or other machinery.

In the harsh marine environment, the fluid lines may be exposed to sun and salt, and may even be partially or fully submerged in the water. In addition, the fluid lines may be cut or damaged if the watercraft strikes debris.

Additionally, exposed fluid lines can be the subject of sabotage or intentional severing in order to disable or damage the machinery.

Fluid cylinder assemblies may also be complicated and difficult to understand and repair. When maintained or replaced, they must be sufficiently understandable so that untrained personnel and relatively unsophisticated maintenance people may correctly repair or install them. Improper installation or maintenance may cause poor operation and premature failure. Therefore, it is desirable that the cylinders be made of parts that are simple and easy to construct, and thereby easy to build, as well as disassemble and service.

It is accordingly an object of the present invention to provide an improved cylinder assembly wherein the parts are more simply made and assembled than in devices heretofore available, and wherein the elements of construction are particularly well adapted to withstand the rigors of operation to which they are subjected.

One of the more specific objects of the invention is to provide a fluid cylinder assembly wherein the external hydraulic lines are eliminated by using internal chambers and channels that extend through certain elements of the apparatus.

A further object of the invention is to provide an improved cylinder and piston assembly including one or more linear position sensors capable of sending electronic signals to indicate the position of the piston relative to the cylinder. A further object is to provide an improved sealing and assembly mechanism for a piston rod in a hydraulic cylinder assembly wherein repair of the rod seal is easily accomplished and assembly and disassembly is more readily performed.

Other objects, advantages and features of the invention, as well as equivalent structures which are intended to be covered herein will become more apparent with the teaching of the principles of the invention in connection with the disclosure of the preferred embodiment thereof in the specification, claims, and drawings.

SUMMARY OF THE INVENTION

The present invention comprises an internally ported fluid cylinder assembly, wherein the cylinder may be mounted to a surface and may have the required fluid delivery lines pass through the surface at the mounting location, thereby eliminating the requirement of fluid lines that are external to the surface. A major advantage of the present invention is the capability of having multiple fluid delivery lines extend from a single end portion of the cylinder assembly parallel to the longitudinal axis of the assembly. Conventional fluid delivery lines typically extend from the cylinder perpendicular to the longitudinal axis of the cylinder.

While the present invention helps to prevent failure of fluid delivery lines, it also provides environmental protection upon fluid delivery line failure or breakage. Oil is commonly used within fluid cylinder assemblies for lubrication and operation. When a conventional fluid line fails, the oil contained therein may escape and cause environmental contamination. Because the present invention eliminates external fluid lines, failure due to environmental exposure, accident or sabotage is unlikely. If for some reason a fluid line should fail, any fluid leak will be contained within the machine or vessel and will not escape into the environment. In fact, a small internal reservoir may be designed into the machine or vessel to catch and contain any fluid escapement in the unlikely event of failure.

The present invention may incorporate internal linear position sensors, thereby allowing the precise extension of the cylinder assembly to be known. Linear position sensors within the present invention may also be installed without the requirement of lines or wires that are external to the machine or vessel.

Another advantage of the present invention is having multiple internal ports that provide the same change in volume of fluid per length of extension or retraction of the cylinder assembly piston. Thus, the cylinder assembly may extend and retract at the same speeds when a single motor effects the fluid delivery for both extend and retract operations.

An exemplary application of the present invention is associated with marine outdrive units, which are typically used on large and/or powerful marine vessels. A typical marine outdrive apparatus has a tubular drive shaft support casing secured to and extending rearwardly from the transom of a boat. The casing connects at its proximal end to the boat transom using a pivoting connection, such as a ball joint. The casing supports a drive shaft that extends from within the boat through the casing to a propeller located at the distal end of the support casing. A universal join means located along the drive shaft coincides with the pivot point of the ball joint. This allows the propeller and distal end of the casing to move along a spheroidal path relative to the ball joint while still receiving power.

The marine outdrive apparatus lends itself to the use of one or more fluid cylinder assemblies connected between the boat transom and the support casing to control movements in the horizontal plane, and one or more fluid cylinder assemblies to control movements in the vertical plane. Horizontal and vertical movement controls provide respective steering and trim control of the boat while the boat is underway.

Conventional cylinder assemblies used in a marine outdrive apparatus are subject to the drawbacks and limitations described in the Background of the Invention. The present invention eliminates fluid lines that are external to the vessel, thereby providing a longer operational life for the assembly, reducing maintenance requirements, providing greater security, reducing the possibility of environmental contamination and providing a more aesthetically pleasing vessel. The present invention also enhances safety by reducing the likelihood of loss of control over the vessel.

It is an object of the present invention to provide a cylinder design incorporating internal fluid channels and linear position sensor lines, thereby eliminating the disadvantages of having exposed fluid delivery lines and electrical cables that are external to the machinery or vessel.

Thus, it is a major object of the present invention to provide marine hydraulic steering and trim control cylinder assemblies that afford the advantages of presently utilized cylinders but eliminate the danger of damaging fluid lines due to exposure, intentional severing or by contact with debris.

It is an object of the present invention to provide fluid cylinders that may pivot as required in any direction or degree, and have an extension length that is required by the application for which the specific embodiment of the invention is used.

It is an object of the present invention to provide appropriate seals for proper sealing of all internal porting and passageways required to isolate the respective extend and retract functions of the cylinder.

It is an object of the present invention to provide means to isolate linear position sensor technology integral to the internal porting and still be capable of full functionality of both the cylinder assembly and the position sensor.

It is an object of the present invention to provide proper porting through an end section of the cylinder assembly and to provide proper internal channels and chambers for the unrestricted flow of fluid for both extend and retract functions of the cylinders and to obtain necessary cycle times.

It is an object of the present invention to provide proper means to seal the cylinder mount to the mounting surface, thereby preventing any external matter or fluid from entering the vessel, and also preventing any cylinder assembly fluid from escaping from the vessel into the environment.

It is an object of the present invention to provide cylinder elements capable of reliably and continuously withstanding the required loading and internal and external pressures, while at the same time providing adequate and proper internal chambers and channels necessary to accomplish operation of the assembly.

It is an object of the present invention to provide external anti-rotation devices to prevent any fluid cylinders from rotating during operation, which could cause attached cables and fluid delivery lines to twist and fail prematurely.

It is an object of the present invention to provide an aesthetic and compact design with the ability to accomplish all functions and operations of a conventional fluid cylinder assembly without the need for fluid delivery lines that are external to the surface upon which the cylinder assembly is mounted.

DETAILED DESCRIPTION

Figure 1:
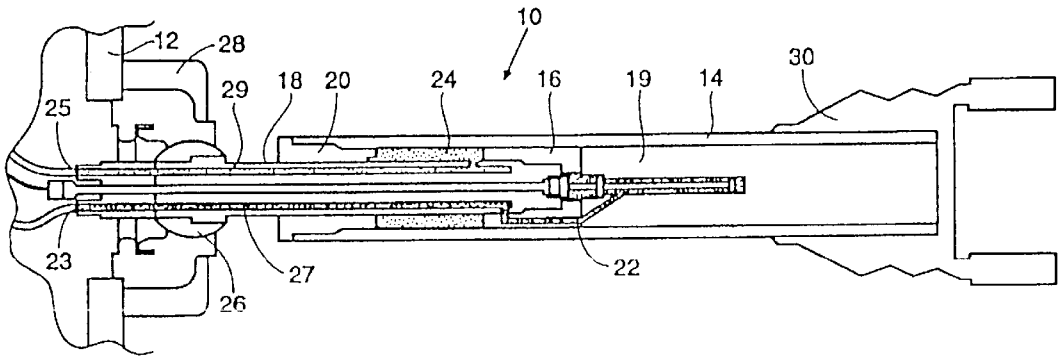
FIG. 1 is a sectional view of an embodiment of the present invention in the fully retracted position taken substantially through the central axis.
Figure 2:
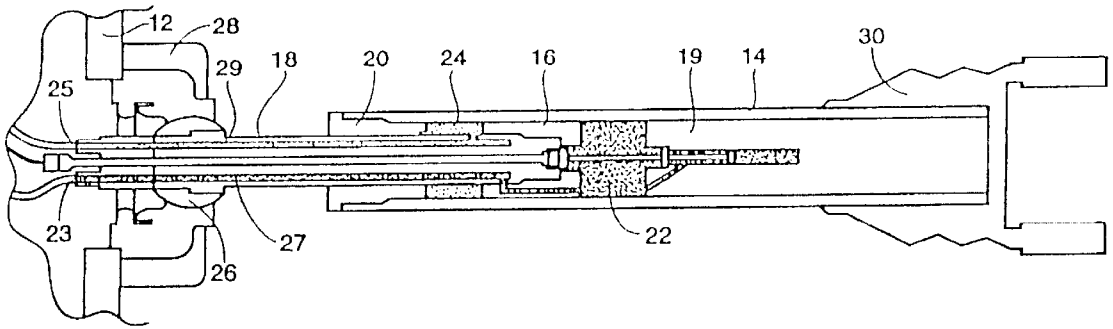
FIG. 2 is a sectional view of an embodiment of the present invention in a partially extended position taken substantially through the central axis.

Although the disclosure hereof is detailed and exact to enable those skilled in the art to practice the invention, the physical embodiments herein disclosed merely exemplify the invention that may be embodied in other specific structure. While the preferred embodiments have been described, the details may be changed without departing from the invention, which is defined by the claims.

The term fluid, as used herein, shall be defined as a gas including air, a liquid, a substance that flows, or a substance that differs from a solid in that it can offer no permanent resistance to change of shape. It shall further include mixtures of gases, mixtures of liquids, and mixtures of gases and liquids.

Fluid piston cylinder assemblies are well known in the art. A major drawback to a conventional cylinder assembly is the existence of fluid delivery lines that are external to the vehicle or machine in which the cylinder assembly is used. Referring to FIGS. 1–4, inclusive, an embodiment of the present invention is depicted. The present invention comprises a fluid piston cylinder assembly 10, that when mounted on a surface 12, has no external ports or fluid carrying lines.

The present cylinder assembly 10 includes a cylindrical barrel 14, a dynamic piston 16, a piston rod 18 coupled to said dynamic piston 16, a gland 20, a first fluid chamber or extend chamber 22, a first fluid channel or extend channel 27, a first external fluid port or external extend port 23, a second fluid chamber or retract chamber 24, a second fluid channel or retract channel 29, a second external fluid port or external retract port 25, a static piston 19, a mount 28 and a base 30.

To aid in distinguishing between the extend chamber 22 and the retract chamber 24 in the Figures, the extend chamber 22 and extend channel 27 have been shaded using a relatively darker shading, while the retract chamber 24 and retract channel 29 have been shaded using a relatively lighter shading.

Figure 3:
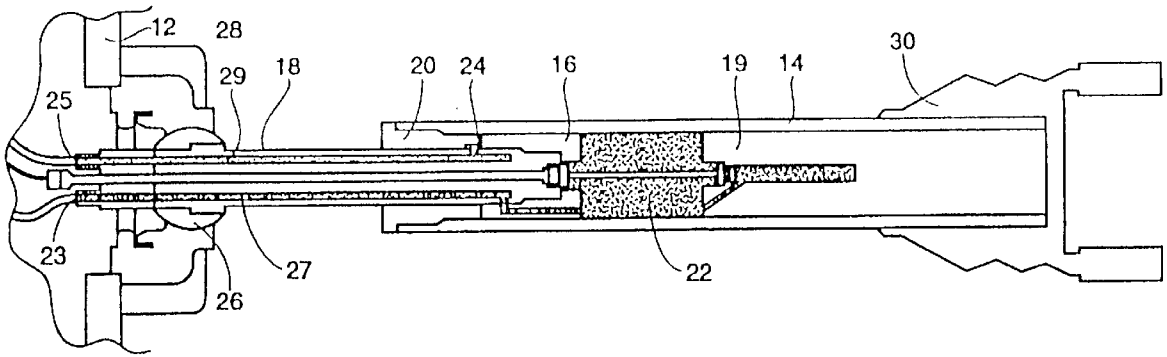
FIG. 3 is a sectional view of an embodiment of the present invention in the fully extended position taken substantially through the central axis.

Fluid cylinder assembly 10 operation is similar to a conventional fluid cylinder assembly. Referring to FIG. 1, the present cylinder assembly 10 is shown in the fully retracted position. As fluid enters the external extend port 23 and travels through the extend channel 27 into the extend chamber 22, the dynamic piston 16 and piston rod 18 move longitudinally relative to the barrel 14 and away from the static piston 19. At the same time, fluid formerly in the retract chamber 24 exits the cylinder assembly 10 through the retract channel 29 and the retract port 25. The dynamic piston 16 will continue to move until fluid is no longer pumped into the extend chamber 22, or until the cylinder assembly 10 reaches the fully extended position, as depicted in FIG. 3.

To accomplish retraction, fluid is pumped through the retract port 25 and retract channel 29 into the retract chamber 24, causing the dynamic piston 16 and piston rod 18 to move longitudinally relative to the barrel 14, toward the static piston 19. Accordingly, fluid in the extend chamber 22 is allowed to exit the cylinder assembly 10 as retraction occurs.

Figure 4:
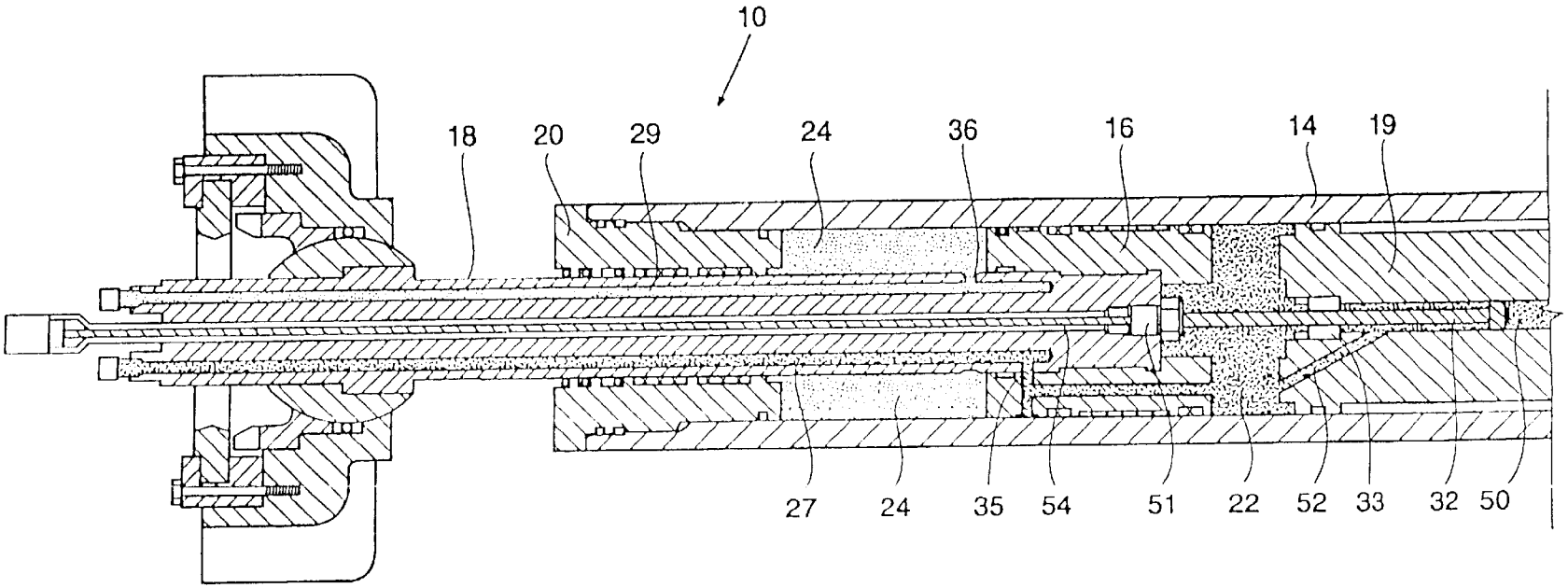
FIG. 4 is a detailed sectional view of a portion of an embodiment of the present invention in a partially extended position taken substantially through the central axis.

Referring specifically to FIG. 4, the present cylinder assembly 10 is shown in greater detail. As stated, the present embodiment includes fluid channels 27, 29 that extend through the piston rod 18. The first fluid channel 27 currently exits the piston rod 18 at a first internal fluid port 35 and continues through the dynamic piston 16. The first fluid channel 27 terminates upon reaching the first fluid chamber 22.

A second internal fluid port 36 in the piston rod 18 allows fluid to pass between the second fluid channel 29 and the second fluid chamber 24. While the present embodiment includes a single internal fluid port 35, 36 for each fluid channel 27, 29, and a single fluid channel 27, 29 for each direction of dynamic piston 16 movement, the invention is not so limited. If desired, multiple internal fluid ports may be used, which may help balance the internal fluid flow. Additionally, a plurality of fluid channels and an according number of internal and external fluid ports may be used. This may increase the speed of operation.

It should be noted that although the aforementioned internal passageways of the present embodiment have been used, the invention should not be limited to this exact configuration of channeling. Either of the internal fluid channels 27, 29 may be designed to pass through the gland 20, the barrel 14, or any other element of the device without departing from the present invention.

The present cylinder assembly 10 may also include a linear position sensor device. Linear position sensors are well known in the art and typically include a linear rod assembly 32 and a wiper carriage assembly 33. A non-rotation pin 51 may also be provided to keep the sensor from rotating within the cylinder. When included within the cylinder assembly 10, a sensor rod chamber 50 and sensor rod chamber channel 52 may be included to allow fluid to lubricate the operation of the linear position sensor. A signal from the linear position sensor is carried out of the cylinder assembly by a communication cable 54 that extends through the piston rod 18 and out of the cylinder assembly 10. Output information from the linear position sensor may be displayed to inform an operator of the amount of extension of the cylinder assembly.

Figure 5:
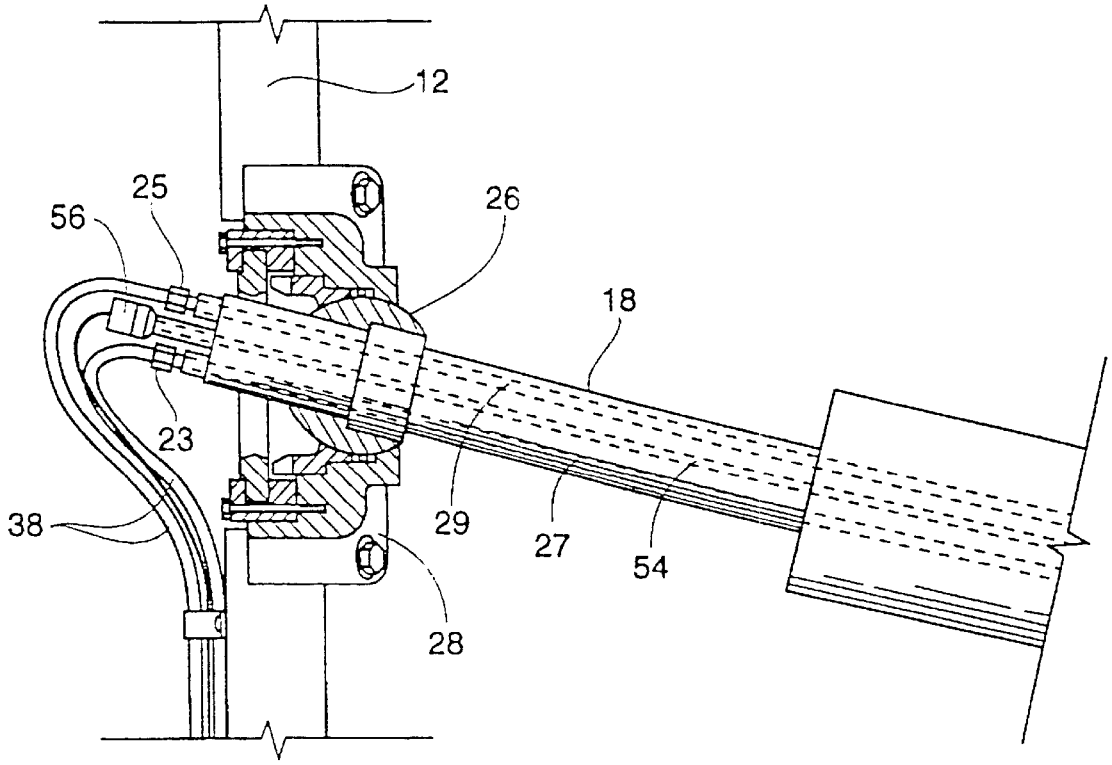
FIG. 5 is a partial side view of an embodiment of the present invention mounted to a surface and including a pivotable connection.
Figure 6:
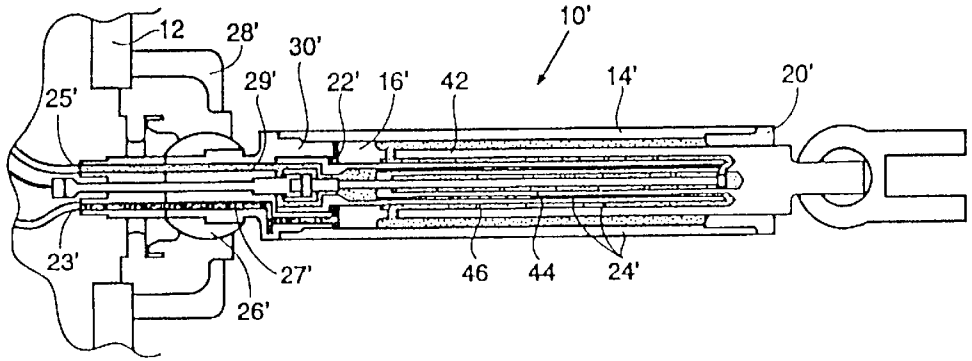
FIG. 6 is a sectional view of an alternative embodiment of the present invention in the fully retracted position taken substantially through the central axis.

Referring to FIG. 5, the present cylinder assembly may also include a pivoting connection 26, such as a ball joint or hinge, which allows the entire hydraulic cylinder assembly 10 a range of motion relative to the mount 28 and the mounting surface 12. The pivoting connection 26 allows the cylinder assembly 10 to be used in applications that require lateral or arcuate movement of the base 30 relative to the mount 28.

In the present embodiment, the piston rod 18, linear position sensor cable 54 and fluid channels 27, 29 extend through the pivoting connection 26. To accomplish pivoting around the connection 26 without damage to the fluid ports 23, 25 or channels 27, 29, flexible fluid delivery lines 38 may be connected to the fluid ports 23, 25 behind the mounting surface 12. As the cylinder assembly 10 pivots around the pivoting connection 26, the flexible fluid lines 38 bend but will not break. A strain relief fitting 54 may also be included to allow pivoting without damage to the linear position sensor cable 54.

It should be noted that in a typical application, multiple fluid cylinder assemblies 10 may receive fluid from a common reservoir and a single fluid pump. Therefore, the fluid to accomplish both extend and retract functions is commonly delivered to either port 23, 25 at the same pressure. The flow rate, however, is dictated by the specific application of the cylinder assembly 10 as well as the specific function of the cylinder assembly 10.

In many applications, it is desirable for the cylinder assembly 10 to extend and retract at the same rate. This is accomplished by providing the extend chamber 22 and retract chamber 24 with equal displacements of volume as the piston 16 moves from the fully extended position to the fully retracted position, or vice versa. The overall volumes of the chambers 22, 24 need not be identical; only the volume of displacement as the piston 16 moves.

However, if the desired rate of extension differs from the desired rate of retraction, the displacement of volume within either chamber 22, 24 may be adjusted. For example, if a slower extension is desired, the displacement volume may be increased.

Now referring to FIGS. 6–9, inclusive, an alternative embodiment 10' of the present invention is depicted. The alternative embodiment 10' comprises a barrel 14', a dynamic piston 16', an outer rod 42 coupled to said dynamic piston 16', an inner rod 44 coupled to said outer rod 42, a gland 20', a first fluid chamber or extend chamber 22', a first fluid channel or extend channel 27', a first fluid port or extend port 23', a second fluid chamber or retract chamber 24', a second fluid channel or retract channel 29', a second fluid port or retract port 25', a static rod 46 within said barrel 14', a mount 28' and a base 30'.

Figure 7:
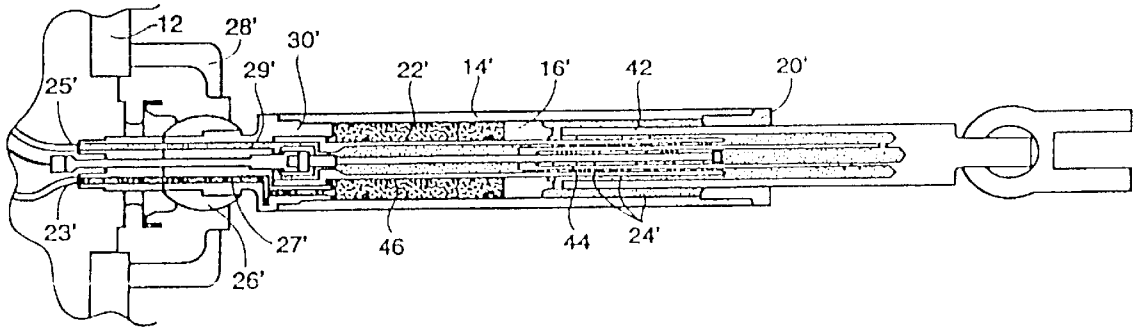
FIG. 7 is a sectional view of an alternative embodiment of the present invention in a partially extended position taken substantially through the central axis.
Figure 8:
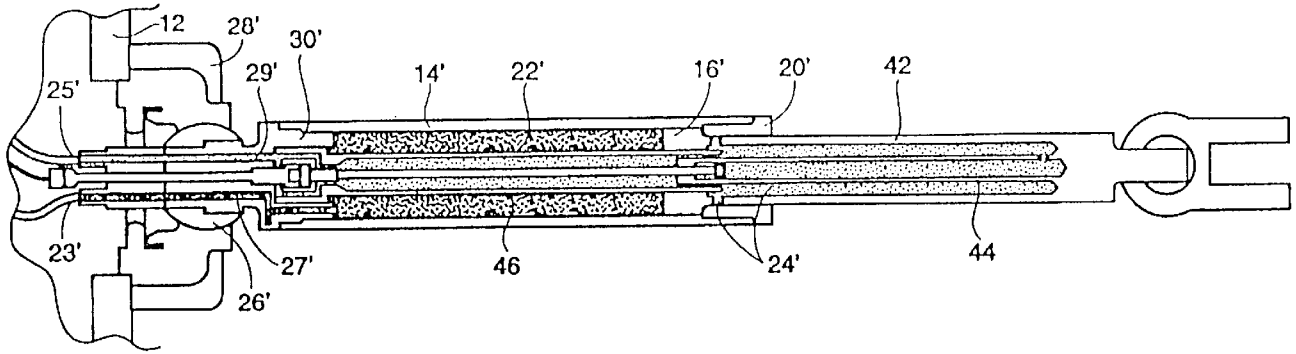
FIG. 8 is a sectional view of an alternative embodiment of the present invention in the fully extended position taken substantially through the central axis.

The alternative fluid cylinder assembly 10' is depicted in the fully retracted position in FIG. 5. As fluid enters the extend chamber 22', the dynamic piston 16', inner rod 44 and outer rod 42 extend along the longitudinal axis of the assembly 10'. Simultaneously, fluid exits the retract chamber 24'. Extension will continue until fluid is no longer pumped into the extend chamber 22', or until the cylinder assembly 10' reaches the fully extended position, as depicted in FIG. 7. Accordingly, retraction is accomplished by pumping fluid into the retract chamber 24'.

The base 30' may be coupled to a mount 28', and the coupling may include a pivot structure 26' to allow the majority of the assembly 10' to pivot relative to the mount 28' and mounting surface 12.

Figure 9:
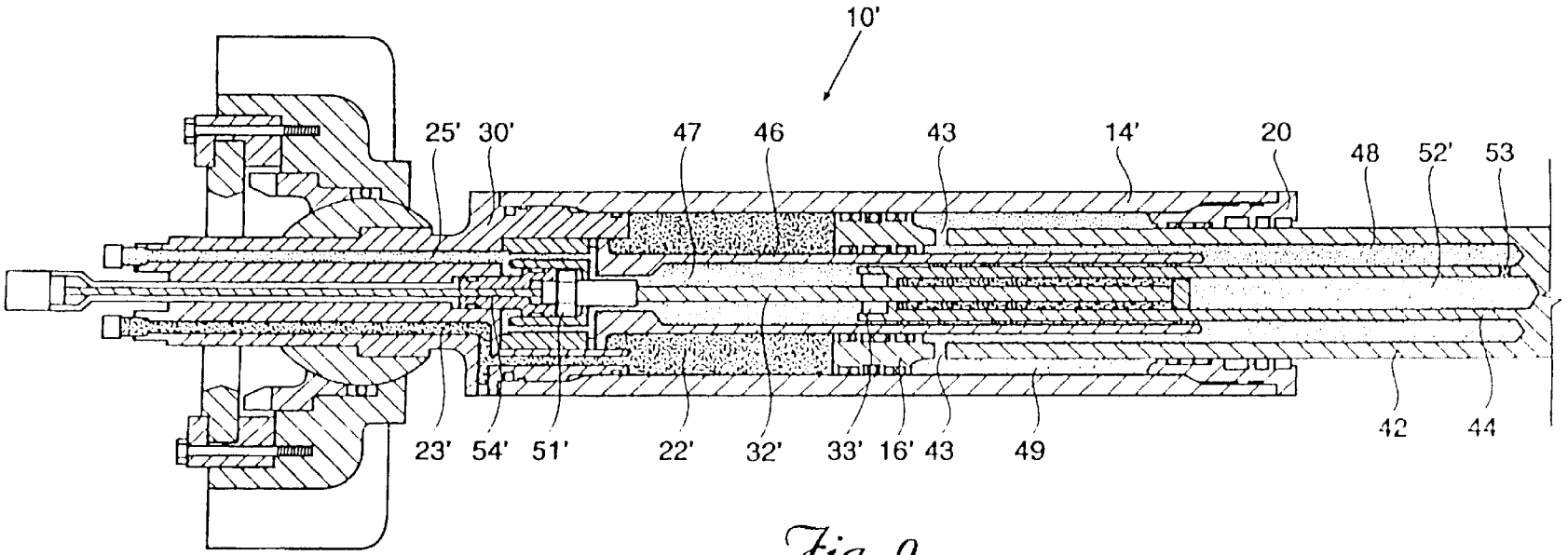
FIG. 9 is a detailed sectional view of a portion of an alternative embodiment of the present invention in a partially extended position taken substantially through the central axis.

Referring specifically to FIG. 9, the alternative embodiment 10' is shown in greater detail. The extend channel 23' passes through the base 30' and terminates at the extend chamber 22'. The retract channel 25' passes through the base 30' and terminates upon reaching the interior portion of the static rod 46.

The retract chamber 24' comprises a number of portions and passageways. A first portion 47 of the retract chamber 24' may be defined by the interior portion of the static rod 46. Fluid passes freely between the first portion 47 and a second portion 48 of the retract chamber 24', comprised of the volume between the outer rod 42 and inner rod 44. A third portion 49 of the retract chamber 24' is comprised of the space between the outer rod 42 and the barrel 14'. Fluid passes between the second portion 48 and third portion 49 through one or more internal ports 43 in the outer rod 42.

As with the previously described embodiment 10, the alternative embodiment 10' may also include a linear position sensor, which may include a linear rod assembly 32', a wiper carriage assembly 33' and a communication cable 54'.

It should be noted that in this alternative embodiment 10', the fluid channels 27', 29' extend through the base 30', while in the aforementioned embodiment, the fluid channels extend through the piston rod 18. The first described embodiment 10 allows the barrel 14 to move along the longitudinal axis of the assembly 10 relative to the mount 28. The alternative embodiment 10' allows the barrel 14' to remain fixed along the longitudinal axis of the assembly 10' relative to the mount 28'. Each embodiment has advantages that may be desired for specific applications.

As with the aforementioned embodiment 10, the alternative embodiment 10' is designed to extend and retract at the same rate by having equal displacement volumes of the extend chamber 22' and retract chamber 24' per unit length of extension or retraction. It should be particularly clear from the alternative embodiment 10' how the displacement volume of a single chamber may be adjusted to accomplish a different extend or retract rate.

Figure 10:
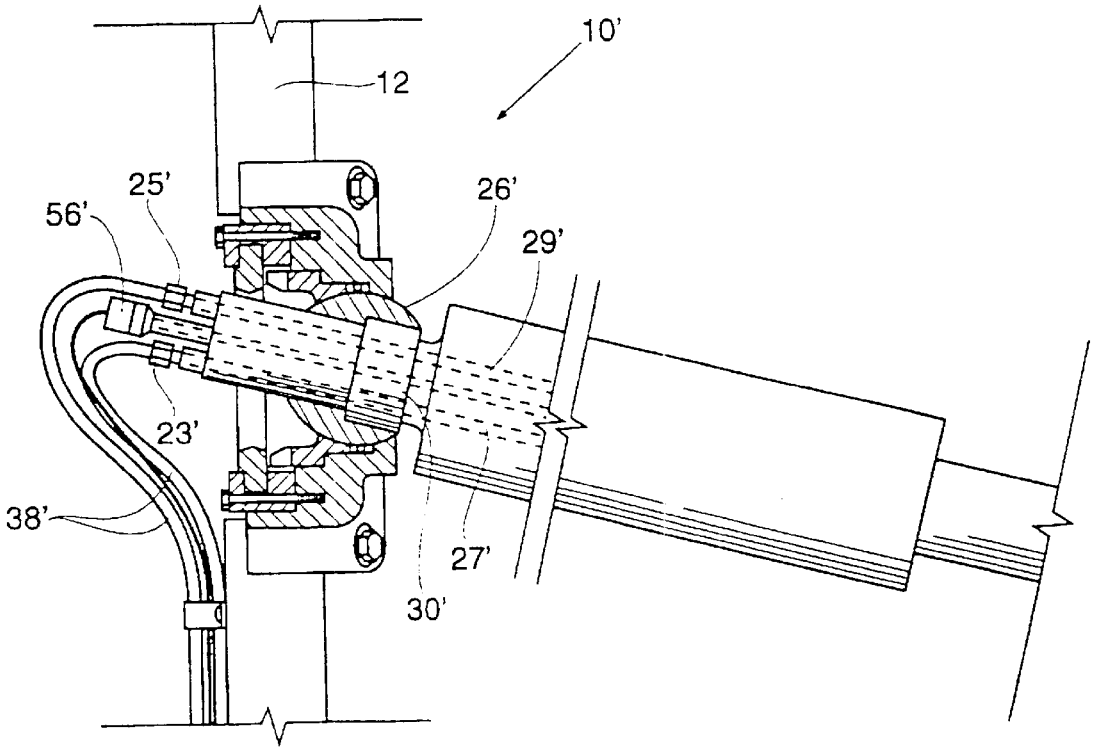
FIG. 10 is a partial side view of an alternative embodiment of the present invention mounted to a surface and including a pivotable connection.

Referring to FIG. 10, the alternative embodiment 10' may also include a pivoting connection 26' that allows the cylinder assembly 10' a range of motion relative to the mounting surface 12. In the alternative embodiment 10', the base extends through the pivoting connection 26'. As with the previously described embodiment 10, flexible fluid lines 38' and a strain relief fitting 56' may be used within the mounting surface 12 to allow movement without damage to any part of the assembly 10'.

The present invention has many applications, but is particularly useful in the marine industry. Marine applications include, but are not limited to, Arneson-type surface drives, fixed shaft surface drives, surface inboard/outboard drives (surfacing), conventional inboard drives, conventional inboard/outboard drives and conventional outboard drives.

Figure 11:
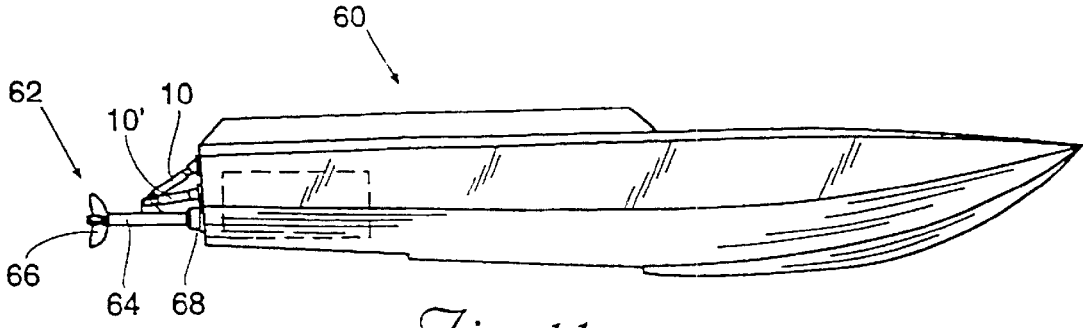
FIG. 11 is a side elevational view of a marine vessel including a marine outdrive unit utilizing an embodiment of the present invention.
Figure 12:
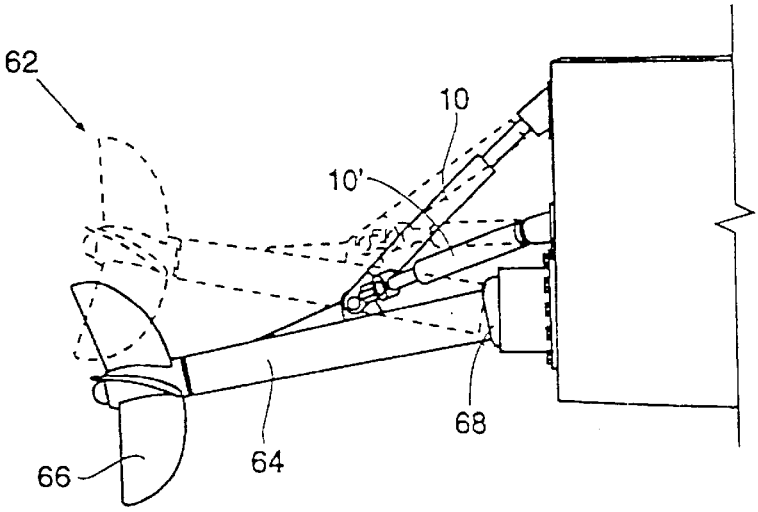
FIG. 12 is a side elevational view of the rear portion of a marine vessel depicting the vertical movement of a marine outdrive unit.
Figure 13:
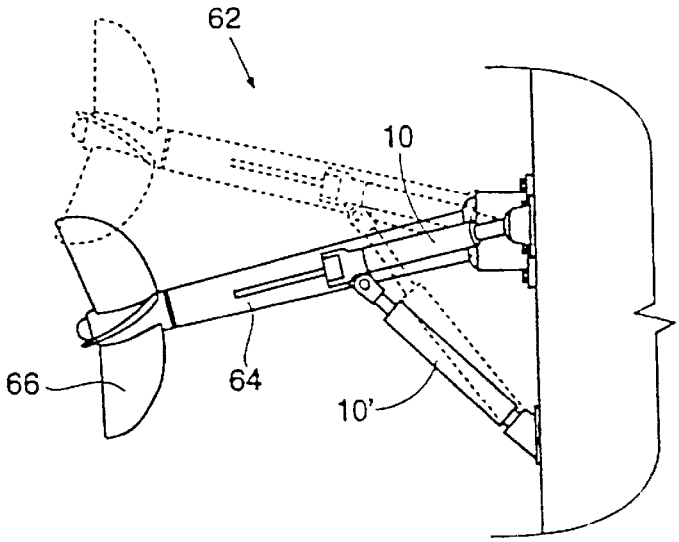
FIG. 13 is a top plan view of the rear portion of a marine vessel depicting the horizontal movement of a marine outdrive unit.

Referring to FIGS. 11–13, inclusive, a marine vessel 60 is depicted that utilizes a marine outdrive unit 62. The main components of a marine outdrive unit 62 may include one or more cylinder assemblies 10, 10', a propeller shaft mount or thrust tube 64, and a propeller 66.

As the cylinder assemblies 10, 10' extend or retract, the position of the propeller 66 and thrust tube 64 shift relative to the marine vessel 60, pivoting around the pivot structure 68. Specifically, the upper cylinder assembly 10 may control vertical movements of the thrust tube 64, as depicted in FIG. 12. As the upper cylinder 10 extends, the thrust tube 64 is lowered and the propeller 36 is pushed deeper into the water. As the upper cylinder 10 retracts, the thrust tube 64 is raised. This allows precise trim control over the marine vessel 60. Hereinafter, the upper cylinder assembly 10 may also be referred to as a trim cylinder assembly 10.

Referring to FIG. 13, the lower cylinder assembly 10' may control horizontal movements of the thrust tube 64. Depending on the configuration of the lower cylinder assembly 10', the thrust tube 64 may move to the left or the right relative to the marine vessel 60 when the assembly 10' is extended. Horizontal movements of the thrust tube 64 and propeller 66 act to steer the marine vessel 60 as it travels through the water. Hereinafter, the lower cylinder assembly 10' may also be referred to as a steering cylinder assembly 10'.

Figure 14:
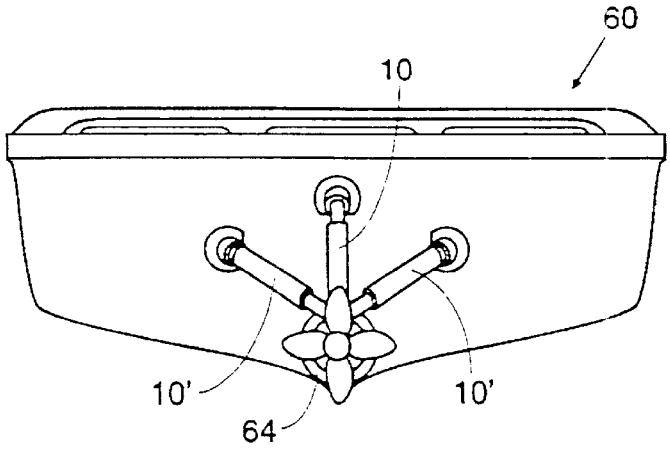
FIG. 14 is a rear elevational view of a marine vessel having two separate outdrive units.

Referring to FIG. 14, in some instances, multiple steering cylinder assemblies 10' may be used with a single trim cylinder assembly 10 and a single thrust tube 64. This provides greater control over the heading of the vessel 60.

Figure 15:
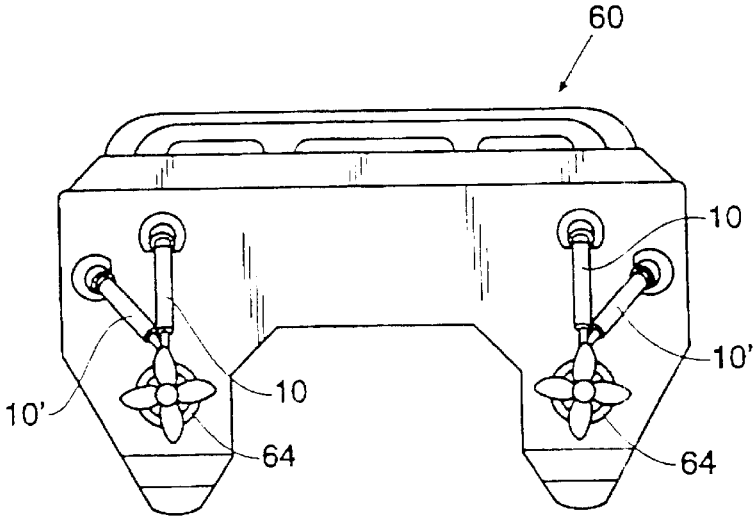
FIG. 15 is a rear elevational view of a marine vessel having a single outdrive unit utilizing multiple steering control fluid cylinders.
Figure 16:
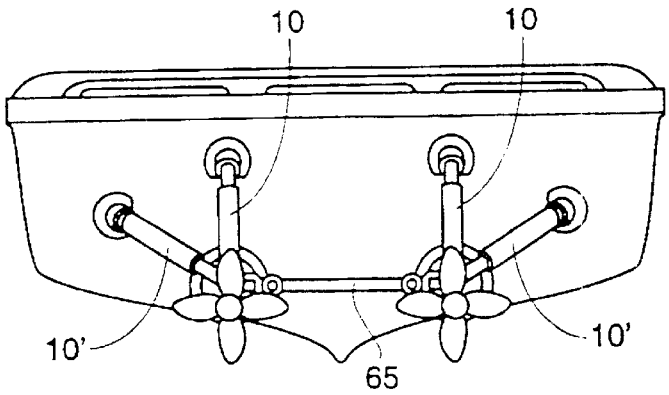
FIG. 16 is a rear elevational view of a marine vessel having two separate outdrive units coupled together by a tie bar.

Referring to FIGS. 15 and 16, in some instances, multiple thrust tubes 64 may be used with multiple steering cylinder assemblies 10' and multiple trim cylinder assemblies 10. The multiple outdrive apparatuses may be separate, or may be coupled together using a mechanical or hydraulic tie bar 65.

Figure 17:
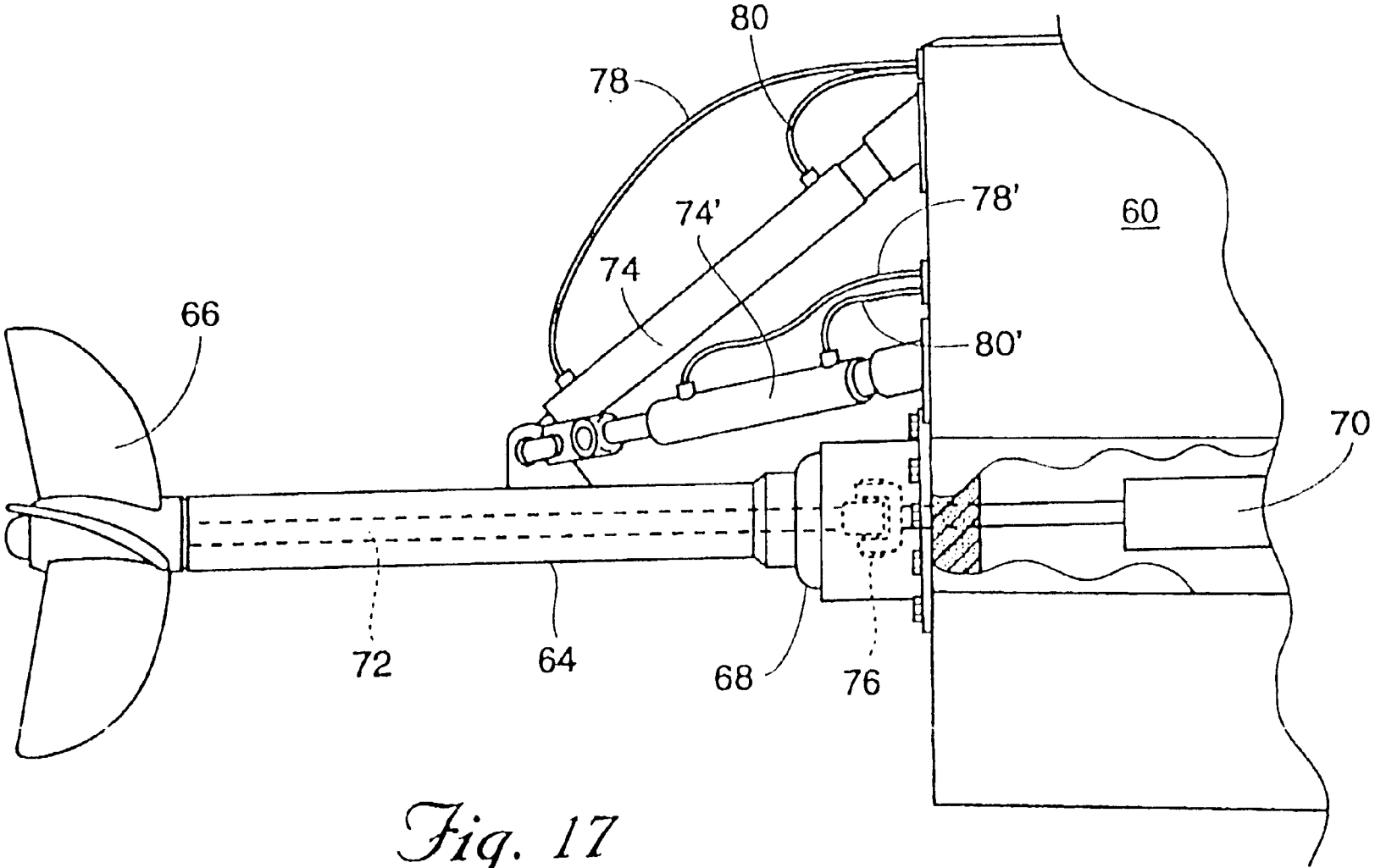
FIG. 17 is an enlarged side elevational view of a marine outdrive unit showing the prior art design.

With specific reference to FIG. 17, a conventional prior art marine outdrive unit is depicted. A drive motor 70 drives a rotatable shaft 72 that connects to and spins the propeller 66. The shaft 72 is supported by the thrust tube 64. To accomplish trim and steering functions, each conventional fluid cylinder assembly 74, 74' is mounted on the marine vessel 60 at one end and coupled to the thrust tube 64 at its opposite end. A universal joint 76 located along the shaft 72 inside the pivot structure 68 allows power delivery to the propeller as the thrust tube 64 pivots relative to the vessel 60.

To accomplish extension and retraction of the conventional cylinder assemblies 74, 74', fluid is provided by conventional external fluid delivery lines 78, 78', 80, 80'.

These external lines 78, 78', 80, 80' are subject to prolonged sun and seawater exposure, and are also in danger of being snagged or intentionally severed. The fluid lines 78, 78', 80, 80' enter the vessel 60 through apertures in the vessel transom, and thereafter typically connect to a valve assembly.

Figure 18:
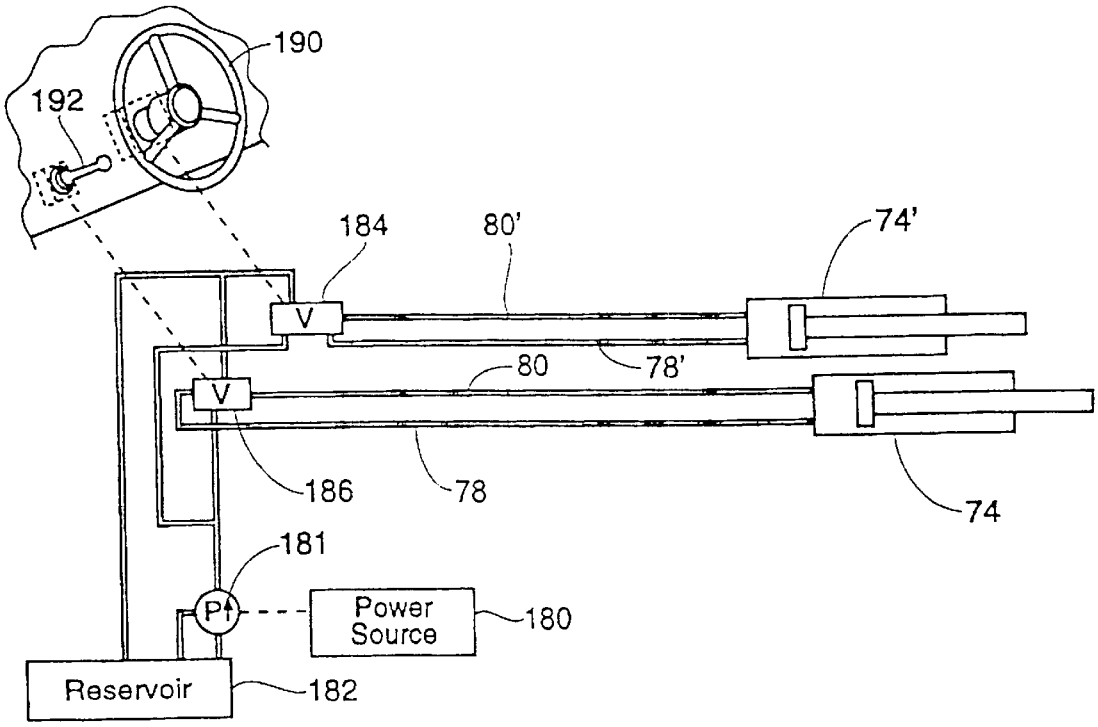
FIG. 18 is a schematic view of a typical steering and trim control system for a boat.

A typical control system for a marine outdrive apparatus is depicted in FIG. 18. Trim input 192 and steering input 190 controls relay a signal to an appropriate valve control assembly 184, 186. A single reservoir 182 and a single pump 181 typically provide fluid to all of the fluid cylinder assemblies 74, 74' of the vessel. A steering valve control assembly 184 controls the fluid traveling to and from the steering cylinder 74', and a trim control assembly 186 controls the fluid traveling to and from the trim cylinder 74. The pump 181 supplies the valve control assemblies 184, 186 with fluid.

Each valve control assembly 184, 186 directs fluid to the appropriate fluid line to accomplish extend or retract functions of the cylinder assembly 74, 74'. For control of the trim cylinder 74, the trim valve control assembly 186 will direct pressurized fluid from the pump 181 to the extend fluid line 80 or retract fluid line 78. The control assembly 186 simultaneously directs returning fluid to the reservoir 182. Operation of the steering valve control assembly 184 and steering cylinder 74' is similar.

Figure 19:
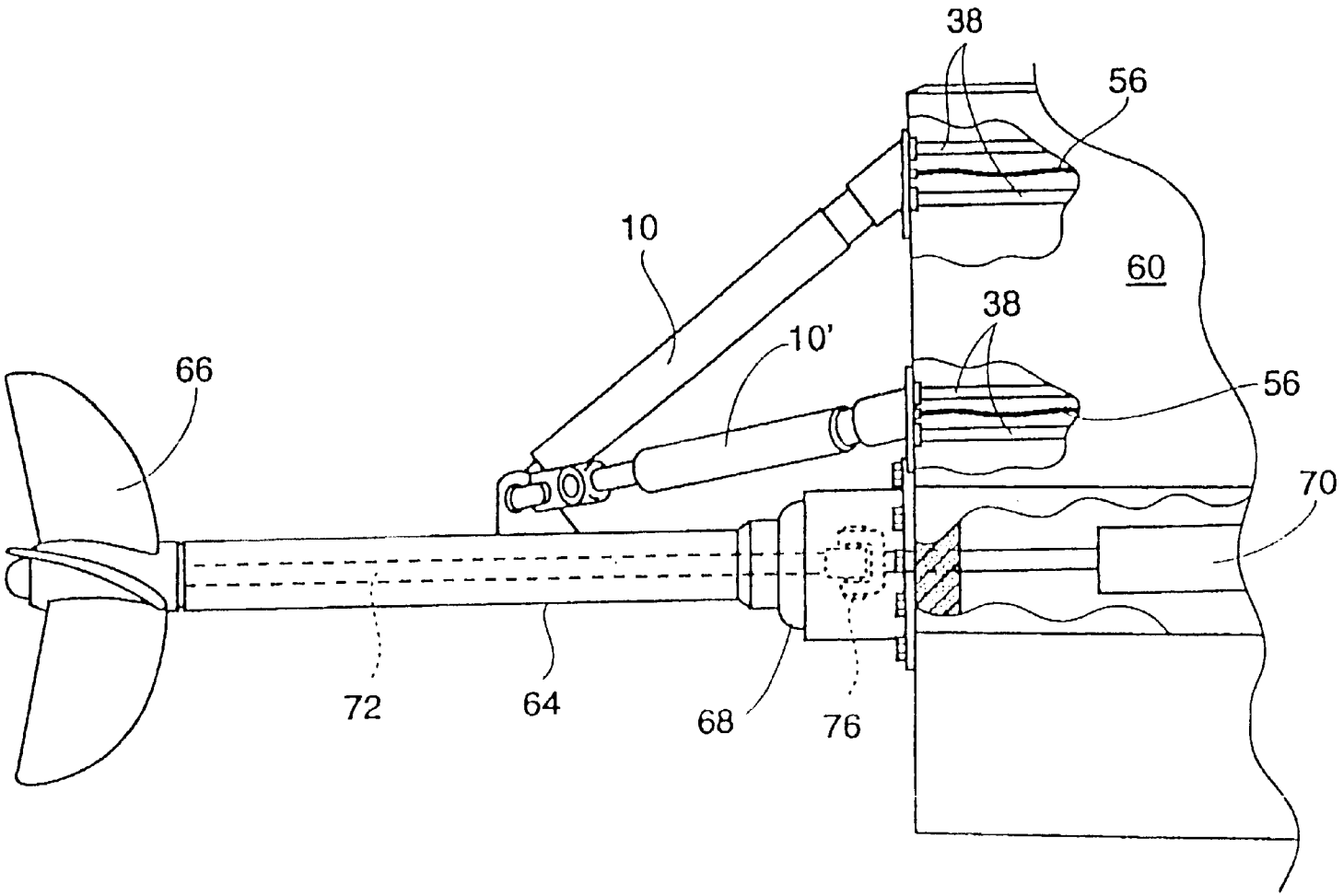
FIG. 19 is an enlarged side elevational view of a marine outdrive unit utilizing an embodiment of the present invention.

Referring to FIG. 19, the present invention is depicted as part of a marine outdrive apparatus. Embodiments of the present invention 10, 10' replace the conventional trim and steering cylinder assemblies. All fluid lines 38 used to accomplish extend and retract functions of the cylinder assemblies 10, 10' pass through the vessel transom directly into the cylinder assembly 10, 10'. No fluid delivery lines 38 are external to the vessel 60.

What is claimed is:

1. A fluid cylinder comprising:

a rod, said rod having a proximal end, an internal fluid inlet channel and an internal fluid outlet channel;

a cylinder body;

said body having a generally cylindrical exterior, a proximal end with a base and an distal end with an aperture, and said body further having an interior, a piston slidably fitted into said interior so to divide said interior into a first fluid chamber, said chamber communicating with an internal fluid inlet passage and a second fluid chamber, said chamber communicating with an internal outlet fluid passage, said piston further carries the rod, said rod extending generally parallel to the cylinder body and extending beyond the body at the distal end, said end having a means to hermetically seal the aperture while adapted to slidably receive said rod;

a fluid inlet port located on the proximal end of the rod, said port communicating with the internal fluid inlet channel of the rod and wherein said channel communicates with the internal inlet fluid passage of the body, said inlet port communicating with the internal inlet fluid passage;

a fluid outlet port located on the proximal end of the rod, said port communicating with the internal fluid outlet channel of the rod and wherein said channel communicates with the internal outlet fluid passage of the body; and a means for mounting the cylinder to a selected object of interest.

2. A means for distributing fluid to a fluid cylinder, said cylinder having a piston rod with a piston, a base, a first chamber and a second chamber, said first and second chambers isolated with respect to each other by the piston, said means comprising:

an inlet port in communication with an internal inlet line, said inlet line in communication with the first chamber; and an outlet port in communication with an internal outlet line, said outlet line in communication with the second chamber;

the inlet port is located on an axial surface of the base and the outlet port is located on the same axial surface of the base.

3. A means for distributing fluid to a fluid cylinder, said cylinder having a piston rod with a piston, a base, a first chamber and a second chamber, said first and second chambers isolated with respect to each other by the piston, said means comprising:

an inlet port in communication with an internal inlet line, said inlet line in communication with the first chamber, said inlet port is located on a distal end of the piston rod; and an outlet port in communication with an internal outlet line, said outlet line in communication with the second chamber, said outlet port is located on the same distal end of the piston rod.

4. A fluid cylinder comprising:

a cylinder body having an axial bore, a first end and an apertured second end, a piston having a piston rod, said piston slidably fitted into said bore so as to divide said bore into a first chamber and a second chamber and wherein said piston rod extends through the apertured second end, an inlet port in communication with an internal inlet line, said inlet line in communication with the first chamber and wherein said inlet port is located on an axial surface of the first end;

an outlet port in communication with an internal outlet line, said outlet line in communication with the second chamber and wherein said outlet port is located on said axial surface of the first end; and a mounting means located at said axial surface of said first end wherein said mounting means comprises a universal joint.

5. A fluid cylinder comprising:

a cylinder body having an axial bore, a first end and an apertured second end, a piston having a piston rod, said piston slidably fitted into said bore so as to divide said bore into a first chamber and a second chamber and wherein said piston rod extends through the apertured second end, an inlet port in communication with an internal inlet line, said inlet line in communication with the first chamber and wherein said inlet port is located on a distal end of the piston rod;

an outlet port in communication with an internal outlet line, said outlet line in communication with the second chamber and wherein said outlet port is located on said distal end of the piston rod; and a mounting means located on said distal end of the piston rod, wherein said mounting means comprises a universal joint.

6. A means for cycling fluid to a fluid cylinder having a piston rod and a cylinder body, said body having a first and second fluid chamber and a base located on a proximal end of the body, said means comprising:

a fluid inlet port formed within said piston rod;

a fluid outlet port formed within said piston rod;

an internal fluid inlet passage communicating said inlet port to the first fluid chamber; and an internal fluid outlet passage communicating said outlet port to the second fluid chamber.

7. The means of claim 6 further comprising locating the outlet port on the base of the body and locating the inlet port on said base, said base generally perpendicular to the longitudinal axis of the cylinder body, and said base opposite the piston rod.

8. The means of claim 6 further comprising locating the outlet port on a distal end of the piston rod and locating the inlet port on said distal end of the piston rod, said distal end further is longitudinally.

9. A marine control cylinder apparatus for a boat having a propeller shaft and a transom, said boat providing a plurality of fluid delivery lines, said apparatus comprising:

a support casing adapted to extend rearwardly from the transom;

means on the rear end of the support casing for forming a ball receiving socket;

a cylinder carrier having a forward end and a rear end and provided with a hollow pivot ball mounted thereon at the forward end thereof, said ball being directly mounted within said socket and universally movable about a pivot point relative to the socket;

a fluid cylinder comprising a rod and a cylinder body, the body further comprises:

a longitudinal axis;

a proximate end, said end having a base;

said base having the inlet port aligned with the longitudinal axis of the body, said inlet port being adjacent to the outlet port, said outlet port being generally longitudinally aligned with the body and adjacent to said inlet port so to locate said inlet and said outlet ports in the same general plane, and in the same general orientation, said orientation being in line with the longitudinal axis of the cylinder body;

said body having an interior, a piston slidably fitted into said interior so to divide said interior into a first fluid chamber and a second fluid chamber;

each of said chambers communicates with a plurality of internal fluid passages wherein a portion of said plurality of passages are contained within the interior of the body;

said piston further carries the rod, said rod extending generally parallel to the cylinder body and extending beyond the body at a distal apertured end, said end having a means to hermetically seal the aperture while adapted to slidably receive said rod;

a fluid inlet port communicating with a first internal fluid passage, the first internal fluid passages further comprises:

an internal fluid inlet passage, said passage communicating with the inlet port and said passage contained substantially within the interior of the body;

and said second internal fluid passage further comprises an internal fluid outlet passage, said passage communicating with the outlet port, said passage contained substantially within the interior of the body;

a fluid outlet port, communicating with a second internal fluid passage;

a means for attaching said cylinder body to said cylinder carrier so that the cylinder body is rotatable on at least one axis; and a means for rotatively engaging the cylinder carrier, said means located at the base, so that said means is adapted to pass the plurality of fluid delivery lines.

10. A fluid cylinder comprising:

a rod;

a cylinder body;

said body having a generally cylindrical exterior, a proximal end with a base and an distal end with an aperture, and said body further having an interior, a piston slidably fitted into said interior so to divide said interior into a first fluid chamber, said chamber communicating with an internal fluid inlet passage and a second fluid chamber, said chamber communicating with an internal outlet fluid passage, said piston further carries the rod, said rod extending generally parallel to the cylinder body and extending beyond the body at the distal end, said end having a means to hermetically seal the aperture while adapted to slidably receive said rod;

a fluid inlet port located on a surface generally perpendicular to a longitudinal axis of the cylinder body;

said inlet port communicating with the internal inlet fluid passage;

a fluid outlet port located on the surface generally perpendicular to the longitudinal axis of the cylinder body, so to be approximately adjacent to said inlet port;

said fluid outlet port further communicates with the internal outlet fluid passage; and a means for mounting the cylinder to a selected object of interest.

11. A marine control cylinder apparatus for a boat having a propeller shaft and a transom comprising:

a support casing adapted to extend rearwardly from the transom;

means on the rear end of the support casing for forming a ball receiving socket;

a cylinder carrier having a forward end and a rear end and provided with a hollow pivot ball mounted thereon at the forward end thereof, said ball being directly mounted within said socket and universally movable about a pivot point relative to the socket;

a fluid cylinder comprising a rod and a cylinder body;

said body having an interior, a piston slidably fitted into said interior so to divide said interior into a first fluid chamber and a second fluid chamber, said piston further carries the rod, said rod extending generally parallel to the cylinder body and extending beyond the body at a proximal apertured end, said end having a means to hermetically seal the aperture while adapted to slidably receive said rod; said cylinder further comprises a fluid inlet port and a fluid outlet port, said inlet port further includes an inlet passage contained within the body of the cylinder and communicates with said first fluid chamber; said fluid outlet port further includes an outlet passage contained within the body of the cylinder and communicates with said second fluid chamber;

said inlet port and said outlet port each being located on a same distal end of the rod;

said proximal rod end being adapted to fit in the socket carried by the transom so that said socket further adapted to receive fluid lines and transmit said lines through the socket so said lines may be connected to the respective inlet port and outlet port; and a means for attaching said cylinder body to said cylinder carrier so that the cylinder body is rotatable on at least one axis.

12. The means for attaching the cylinder body of claim 11 further including rotation on a generally horizontal axis so to steer the boat of interest.

13. The means for attaching the cylinder body of claim 11 further including rotation on a generally vertical axis so to control the trim of the boat of interest.

14. A steering control system for a shaft mounted propeller driven marine craft boat having a propeller shaft and a transom, said system comprising:

a plurality of fluid cylinders;

said fluid cylinders further comprising a proximal end wherein a fluid inlet port and a fluid outline port are located on said same proximal end, wherein said inlet port communicates with an internal inlet fluid passage, said passage communicating with a first fluid chamber, said first fluid chamber separated by a piston from a second fluid chamber, said piston slidably fitted inside the body of the cylinder; said second fluid chamber in communication with an internal fluid outlet passage, said internal outlet passage in communication with said outlet port;

a means for communicating a fluid inlet line to the cylinder;

a means for communicating a fluid outlet line to the cylinder;

a means for rotatively mounting the fluid cylinder to the transom;

a means for steering the boat; and a means for setting trim of the boat.

15. The steering control system of claim 14 wherein the proximal end includes a cylinder body.

16. The steering control system of claim 14 wherein the proximal end includes a piston rod.

17. A means for cycling fluid to a fluid cylinder having a piston rod and a cylinder body, said body having a first and second fluid chamber and a base located on a proximal end of the body, said means comprising:

a fluid inlet port located on said distal end of the piston rod;

a fluid outlet port located on a distal end of the piston rod, said distal end further is longitudinally opposed to the base of the cylinder body;

an internal fluid inlet passage communicating said inlet port to the first fluid chamber; and an internal fluid outlet passage communicating said outlet port to the second fluid chamber.

18. A means for cycling fluid to a fluid cylinder having a piston rod and a cylinder body, said body having a first and second fluid chamber and a base located on a proximal end of the body said base generally perpendicular to the longitudinal axis of the cylinder body, and said base opposite the piston rod, said means comprising:

a fluid inlet port located on said base;

a fluid outlet port located on the base of the body;

an internal fluid inlet passage communicating said inlet port to the first fluid chamber; and an internal fluid outlet passage communicating said outlet port to the second fluid chamber.

19. A means for distributing fluid to a fluid cylinder, said cylinder having a piston rod with a piston, a base, a first chamber and a second chamber, said first and second chambers isolated with respect to each other by the piston, said means comprising:

an inlet port in communication with an internal inlet line, said inlet port formed within said piston rod, said inlet line in communication with the first chamber; and an outlet port in communication with an internal outlet line, said outlet port formed within said piston rod, said outlet line in communication with the second chamber.

20. The means of claim 19 wherein the inlet port is located on an axial surface of the base and wherein the outlet port is located on the same axial surface of the base.

21. The means of claim 19 wherein the inlet port is located on a distal end of the piston rod and the outlet port is located.

* * * * *

UNITED STATES PATENT AND TRADEMARK OFFICE

CERTIFICATE OF CORRECTION

PATENT NO. : 6,726,511 B1
DATED : April 27, 2004
INVENTOR(S) : Buddy C. Schelman It is certified that error appears in the above-identified patent and that said Letters Patent is hereby corrected as shown below:

Column 12,
Line 9, after "and" delete "an" and insert -- a --.

Column 14,
Line 35, after "located" delete "." and insert -- on the same distal end of the piston rod. --

Signed and Sealed this

Third Day of August, 2004

JON W. DUDAS
*Acting Director of the United States Patent and Trademark Office*